US009822433B2

(12) United States Patent
Mito et al.

(10) Patent No.: US 9,822,433 B2
(45) Date of Patent: Nov. 21, 2017

(54) SPHEROIDAL GRAPHITE CAST IRON

(71) Applicant: Kabushiki Kaisha Riken, Tokyo (JP)

(72) Inventors: Kazushige Mito, Tokyo (JP); Naoto Saito, Niigata (JP)

(73) Assignee: Kabushiki Kaisha Riken, Tokyo (JP)

( * ) Notice: Subject to any disclaimer, the term of this patent is extended or adjusted under 35 U.S.C. 154(b) by 0 days.

(21) Appl. No.: 14/901,438

(22) PCT Filed: May 26, 2014

(86) PCT No.: PCT/JP2014/063836

§ 371 (c)(1),
(2) Date: Dec. 28, 2015

(87) PCT Pub. No.: WO2014/208240

PCT Pub. Date: Dec. 31, 2014

(65) Prior Publication Data

US 2016/0160325 A1 Jun. 9, 2016

(30) Foreign Application Priority Data

Jun. 28, 2013 (JP) ..... 2013-135881

(51) Int. Cl.

| | |
|---|---|
| ***C22C 37/10*** | (2006.01) |
| ***C22C 37/04*** | (2006.01) |
| ***C21C 1/10*** | (2006.01) |
| ***C22C 37/06*** | (2006.01) |
| ***B22C 9/22*** | (2006.01) |

(52) U.S. Cl.

CPC ..... *C22C 37/10* (2013.01); *C21C 1/105* (2013.01); *C22C 37/04* (2013.01); *C22C 37/06* (2013.01); *B22C 9/22* (2013.01)

(58) Field of Classification Search

CPC ..... C22C 37/04; C22C 37/06; C22C 37/10; C21C 1/105; B22C 9/22

See application file for complete search history.

(56) References Cited

U.S. PATENT DOCUMENTS

| | | | |
|---|---|---|---|
| 5,186,233 | A | 2/1993 | Obata et al. |
| 2013/0022492 | A1 | 1/2013 | Kuwagaki |
| 2015/0086410 | A1 | 3/2015 | Tabita et al. |
| 2015/0376747 | A1 | 12/2015 | Tyou et al. |

FOREIGN PATENT DOCUMENTS

| | | |
|---|---|---|
| CN | 101565793 | 2/1993 |
| CN | 102268590 | 12/2011 |
| CN | 102747268 | 10/2012 |
| JP | H04308018 | 10/1992 |
| JP | H10102764 | 4/1998 |
| JP | H10324945 | 12/1998 |
| JP | 2001-220640 | 8/2001 |
| JP | 2003-55731 | 2/2003 |
| JP | 4677505 | 4/2011 |
| JP | 2011-190516 | 9/2011 |
| WO | WO 2006/123497 | 11/2006 |
| WO | WO 2014/208240 | 12/2014 |

OTHER PUBLICATIONS

Ichie, Norio, English machine translation of JP 2003-055731, Feb. 2003, p. 1-20.*

Decision to Grant a Patent corresponding to Japanese Patent Application No. 2013-135881, dated Nov. 18, 2015.

International Search Report corresponding to PCT/JP2014/063836, dated Sep. 2, 2014.

Third Party Observations corresponding to PCT/JP2014/063836, dated Jun. 18, 2015.

Translation of Explanation of Situation for Accelerated Examination submitted in Japanese Patent Application No. 2013-135881 dated Sep. 19, 2014.

Translation of the Written Opinion of the International Searching Authority corresponding to PCT /JP2014/063836, dated Sep. 2, 2014.

Notification of Transmittal of Translation of the International Preliminary Report on Patentability corredponding to International Application No. PCT/JP2014/063836 dated Dec. 29, 2015.

* cited by examiner

*Primary Examiner* — Roy King

*Assistant Examiner* — Caitlin Kiechle

(74) *Attorney, Agent, or Firm* — Jenkins, Wilson, Taylor & Hunt

(57) ABSTRACT

A spheroidal graphite cast iron comprising: C: 3.3 to 4.0 mass %, Si: 2.1 to 2.7 mass %, Mn: 0.20 to 0.50 mass %, S: 0.005 to 0.030 mass %, Cu: 0.20 to 0.50 mass %, Mg: 0.03 to 0.06 mass % and the balance: Fe and inevitable impurities, wherein a tensile strength is 550 MPa or more, and an elongation is 12% or more.

2 Claims, 6 Drawing Sheets

SPHEROIDAL GRAPHITE CAST IRON

FIELD OF THE INVENTION

The present invention relates to spheroidal graphite cast iron. In particular, the present invention relates to spheroidal graphite cast iron suitably applied to undercarriage and engine parts of an automobile.

DESCRIPTION OF THE RELATED ART

In order to improve a fuel efficiency of an automobile or the like, it is increasingly needed to reduce weights of vehicle parts. Examples of reducing the weights of the vehicle parts include that spheroidal graphite cast iron used in the related art is replaced with a light alloy such as an aluminum alloy and a magnesium alloy having a small specific gravity. However, a Young's modulus of the light alloy is lower than that of the spheroidal graphite cast iron. If the light alloy is applied to the undercarriage and the engine parts of the automobile, it is needed to enlarge a cross-sectional area for providing rigidity. It is therefore difficult to reduce the weights regardless of the small specific gravity. Also, as the light alloy has higher material costs than the spheroidal graphite cast iron, the application of the light alloy is limited.

On the other hand, there is a method of producing the vehicle parts by working a metal sheet, thereby reducing thicknesses and the weights. However, metal sheet working has limited workability and moldability, resulting in a limited freedom of shape. In the case of a complex shape, an integrated molding becomes difficult. The vehicle parts are divided into a plurality of members, the members are worked to metal sheets, and then the members should be bonded. Undesirably, strength of the bonds decreases, the number of the parts increases, and the manufacturing costs increase.

As the spheroidal graphite cast iron used for undercarriage of an automobile in the related art, FCD400 material and FCD450 material (conforming to JIS G5502) each having a tensile strength of 400 to 450 MPa are frequently used. In order to reduce the weights of the parts using the spheroidal graphite cast iron, FCD500 material and FCD600 material (conforming to JIS G5502) each having a strength higher than that of the FCD400 material and the FCD450 material are used to decrease cross-sectional areas of the parts (see Patent Document 1).

PRIOR ART DOCUMENTS

Patent Literatures

[Patent Literature 1] Japanese Unexamined Patent Publication No. Hei04-308018

SUMMARY OF THE INVENTION

Problems to be Solved by the Invention

However, the above-described FCD500 material and the FCD600 material each has a high tensile strength, but significantly decreased elongation and impact value, which are insufficient to inhibit fracture of the parts upon a vehicle impact. In particular, if the material becomes brittle, a brittle fracture that is a sudden fracture unaccompanied by plastic deformation is easily induced. Even if an impact load of generating a great load in a short time acts on undercarriage and engine parts of an automobile, the parts should not be fractured (separated). A desirable material less induces the brittle fracture, and has high strength, ductility, and toughness.

Mechanical properties generally required by the undercarriage of the automobile are 10% or more of elongation, 10 J/cm$^2$ or more of an impact value at a normal temperature (evaluated with U notched), and 50% or less of percentage brittle fracture.

The present invention is to solve the above-described problems, and an object of the present invention is to provide spheroidal graphite cast iron having high strength and ductility.

Means for Solving the Problem

The present invention provides a spheroidal graphite cast iron comprising: C: 3.3 to 4.0 mass %, Si: 2.1 to 2.7 mass %, Mn: 0.20 to 0.50 mass %, S: 0.005 to 0.030 mass %, Cu: 0.20 to 0.50 mass %, Mg: 0.03 to 0.06 mass % and the balance: Fe and inevitable impurities, wherein a tensile strength is 550 MPa or more, and an elongation is 12% or more.

Preferably, the spheroidal graphite cast iron further comprises: Mn and Cu: 0.45 to 0.60 mass % in total.

Preferably, a ratio of the content of Si by mass % and the total contents of Mn and Cu by mass % (Si/(Mn+Cu)) is 4.0 to 5.5.

Preferably, a graphite nodule count is 300/mm$^2$ or more, and an average grain size of graphite is 20 μm or less.

Preferably, an impact value at normal temperature and −30° C. is 10 J/cm$^2$ or more.

Preferably, a percentage brittle fracture of an impact fracture surface at 0° C. is 50% or less.

Effects of the Invention

According to the present invention, spheroidal graphite cast iron having high strength and ductility is provided.

DESCRIPTION OF THE EMBODIMENTS

Figure 1:
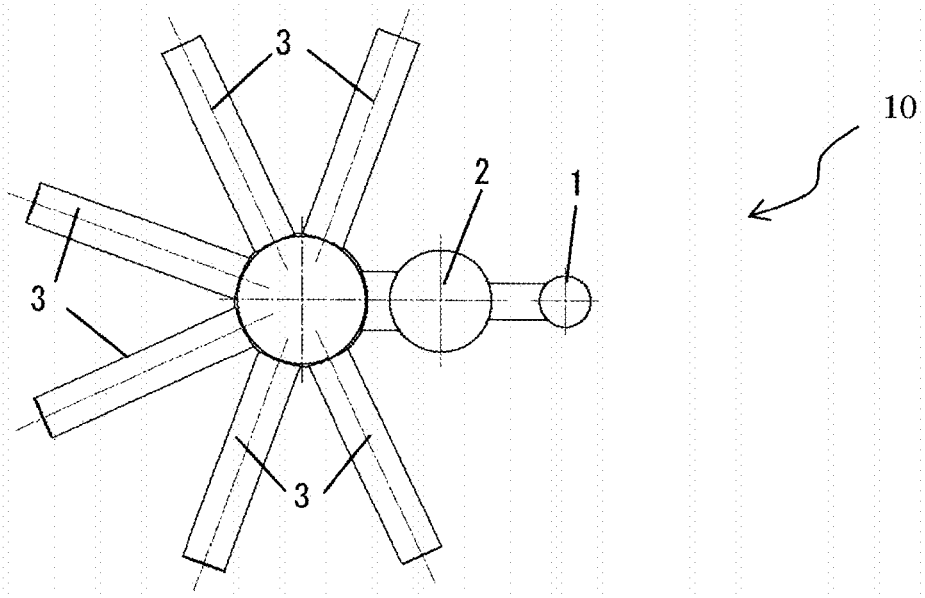
FIG. 1 A top view showing a beta set mold having cavities for producing an example material.
Figure 2:
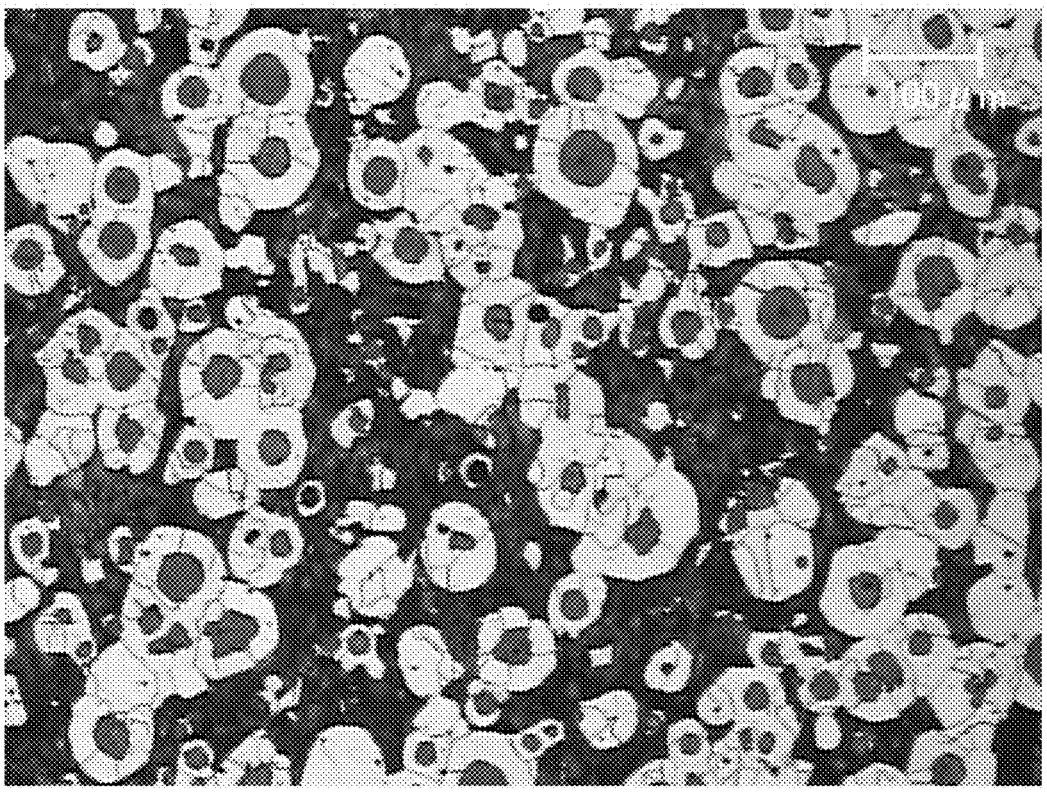
FIG. 2 A photograph showing a structure of a test specimen cross-section in Example 1.
Figure 3:
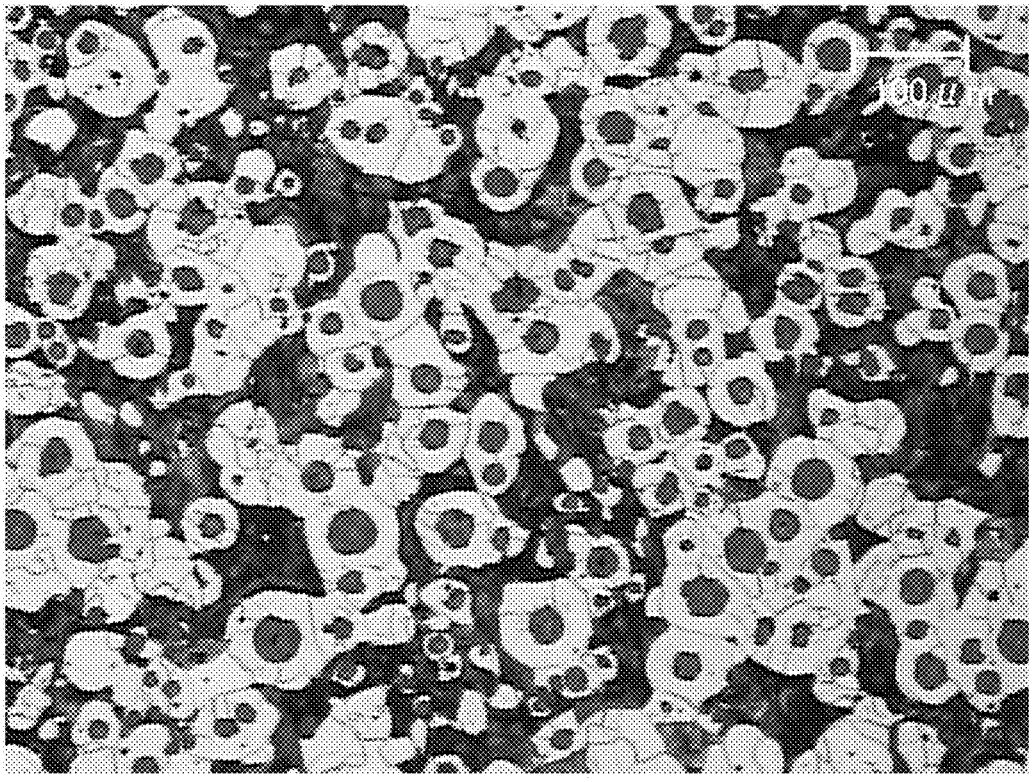
FIG. 3 A photograph showing a structure of a test specimen cross-section in Example 2.
Figure 4:
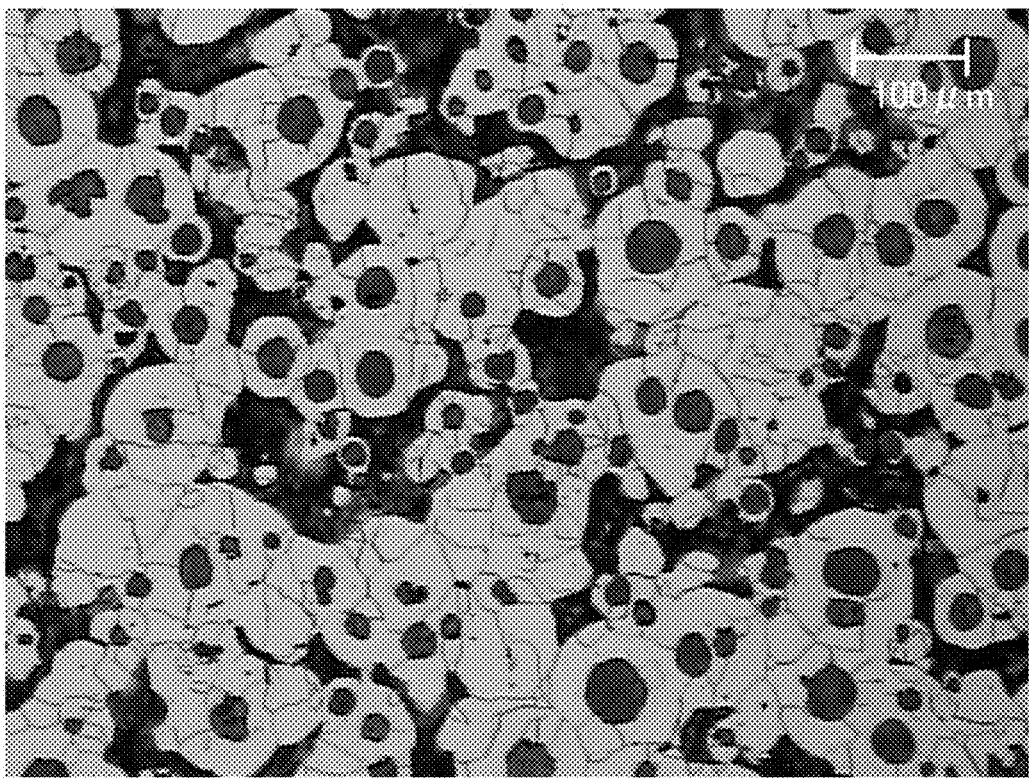
FIG. 4 A photograph showing a structure of a test specimen cross-section in Comparative Example 1.
Figure 5:
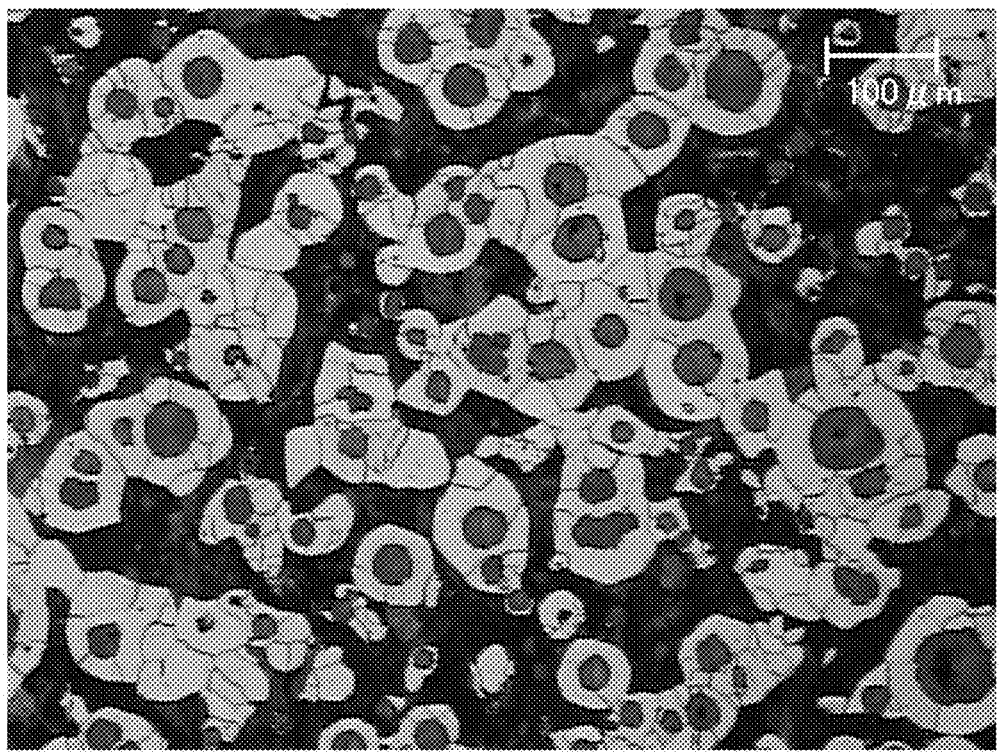
FIG. 5 A photograph showing a structure of a test specimen cross-section in Comparative Example 2.
Figure 6:
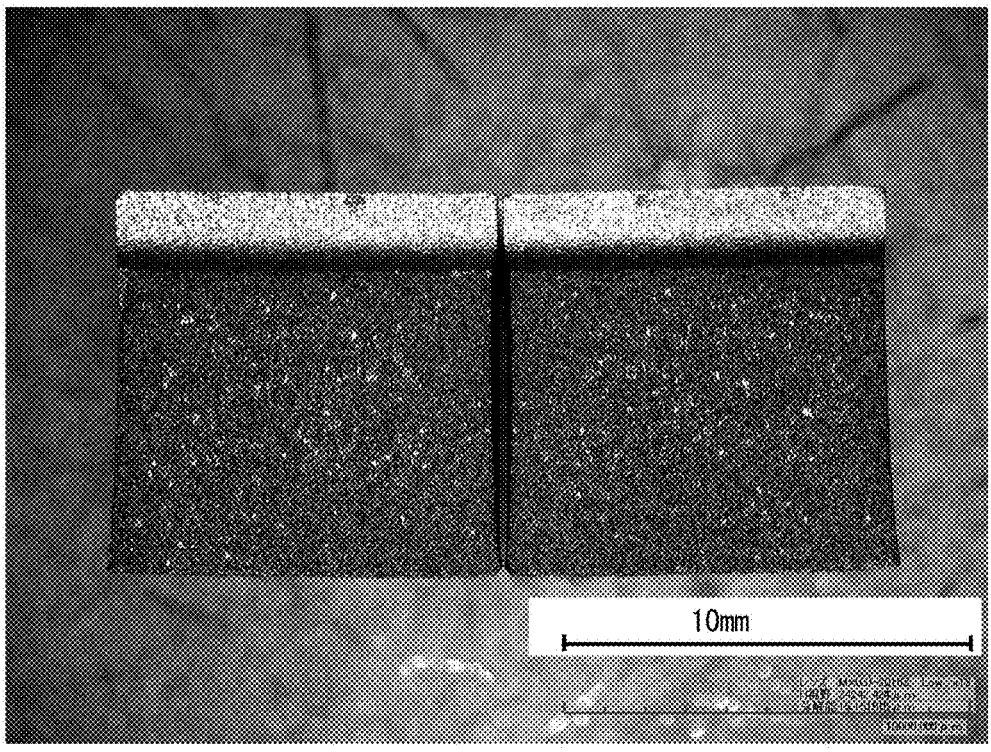
FIG. 6 A photograph showing a fractured surface of a test specimen after an impact test (RT: room temperature) in Example 1.
Figure 7:
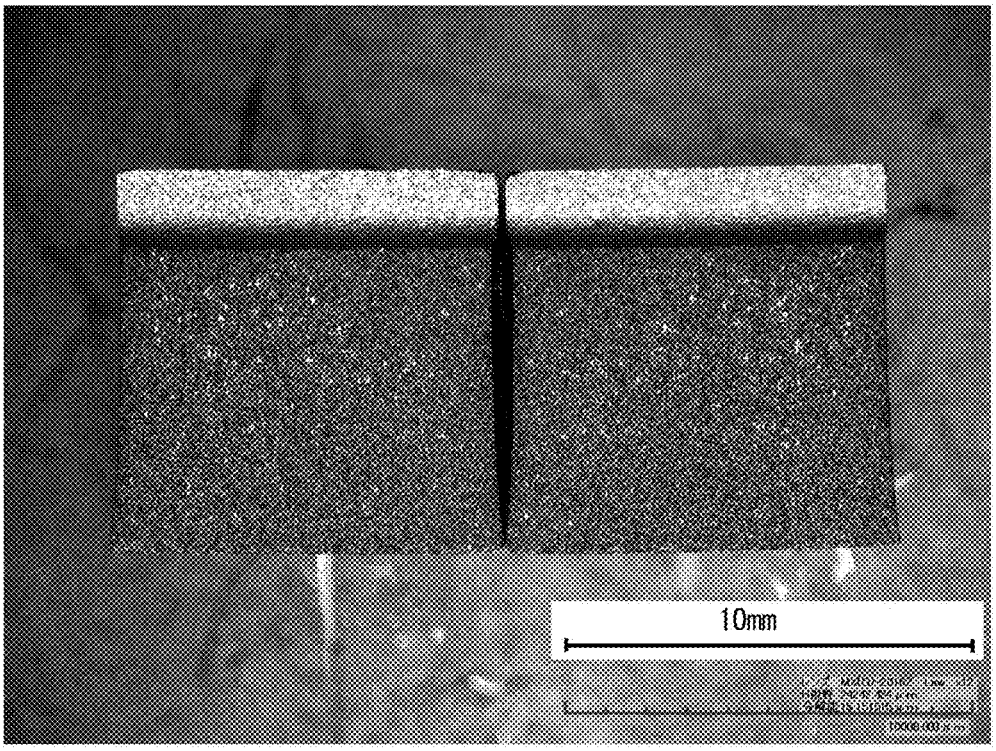
FIG. 7 A photograph showing a fractured surface of a test specimen after an impact test (RT: room temperature) in Example 2.
Figure 8:
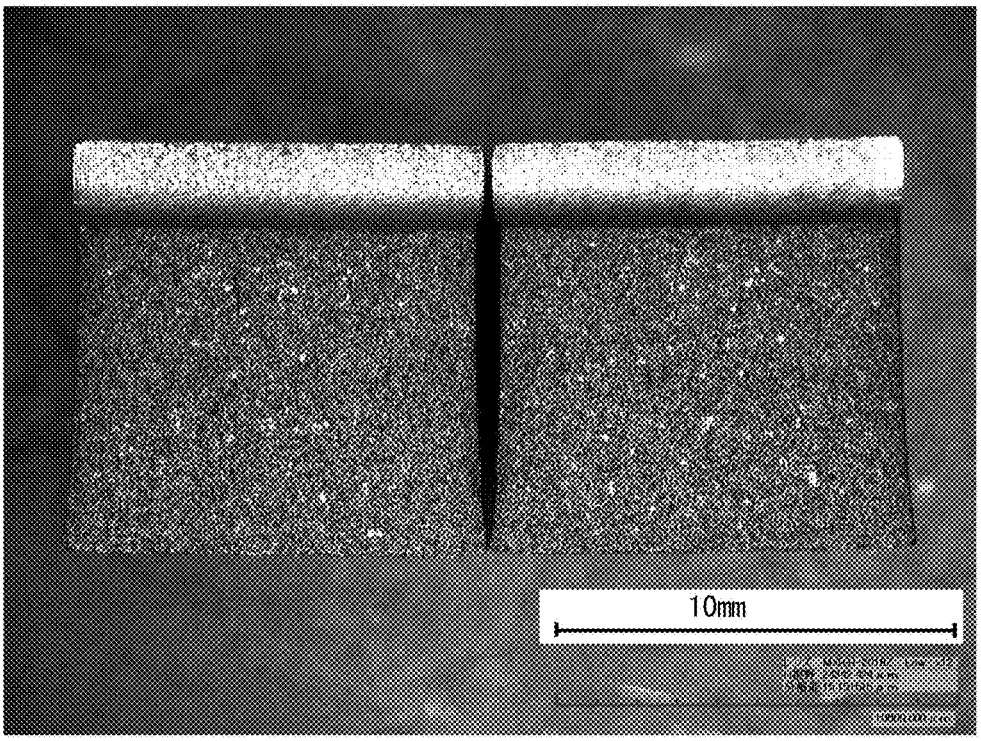
FIG. 8 A photograph showing a fractured surface of a test specimen after an impact test (RT: room temperature) in Comparative Example 1.
Figure 9:
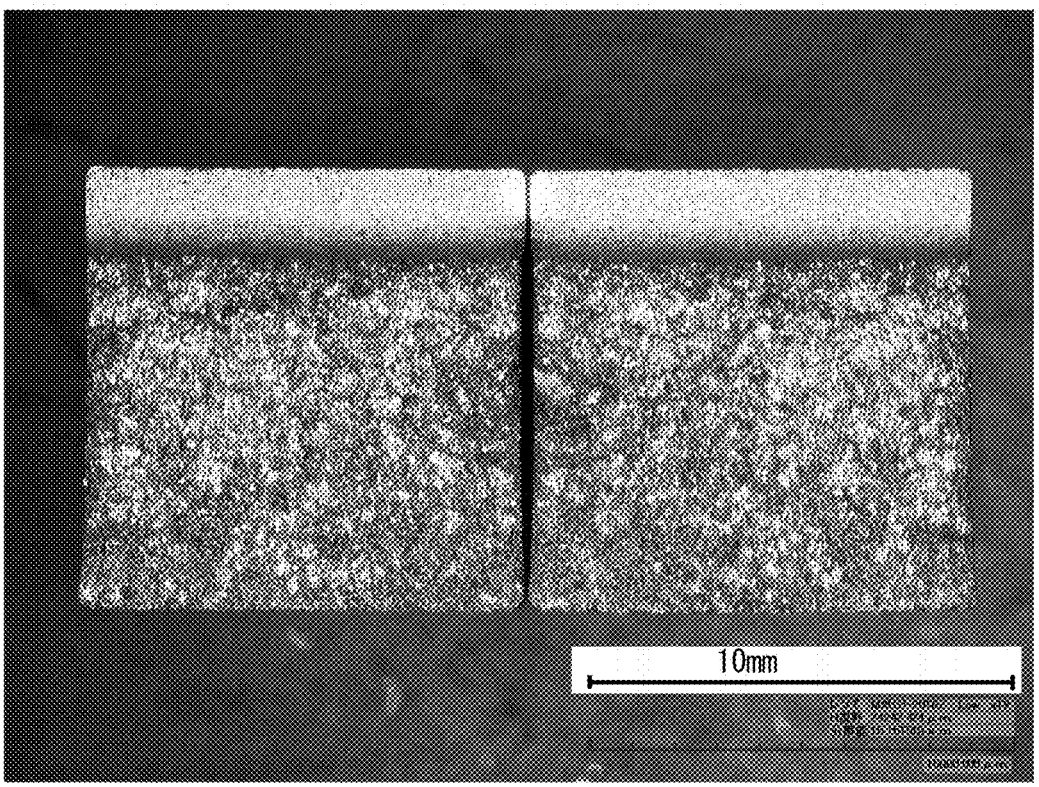
FIG. 9 A photograph showing a fractured surface of a test specimen after an impact test (RT: room temperature) in Comparative Example 2.

Hereinafter, embodiments of the present invention will be described. In the context of the present invention, "%" denotes "mass(weight) %" unless otherwise specified.

The spheroidal graphite cast iron according to the embodiment of the present invention includes C: 3.3 to 4.0 mass %, Si: 2.1 to 2.7 mass %, Mn: 0.20 to 0.50 mass %, P: 0.05 mass % or less, S: 0.005 to 0.030 mass %, Cr: 0.1 mass % or less, Cu: 0.20 to 0.50 mass %, Mg: 0.03 to 0.06 mass % and the balance: Fe and inevitable impurities, and has a tensile strength of 550 MPa or more and an elongation of 12% or more.

<Composition>

C (carbon) is an element of forming a graphite structure. If the content of C is less than 3.3%, a graphite nodule count decreases and pearlite increases, thereby improving the strength, but decreasing the elongation and the impact value. If the content of C exceeds 4.0%, a grain size of graphite increases to form exploded graphite, thereby decreasing a spheroidizing ratio, the elongation and impact value. Therefore, the content of C is 3.3 to 4.0%.

Si is an element for facilitating crystallization of graphite. If the content of Si is less than 2.1%, the elongation increases, but the strength may decreases. If the content of Si exceeds 2.7%, the impact value may decreases by the effect of silicon ferrite. Therefore, the content of Si is preferably 2.1 to 2.7%. In order to dissolve an optimal amount of Si into a matrix structure, the content of Si is more preferably 2.1 to 2.4%. If the content of Si is 2.7% or less, it is conceivable that the amount of dissolving Si into the matrix structure decreases, an embrittlement at a low temperature is mitigated, and impact absorption energy increases.

Mn is an element for stabilizing a pearlite structure. If the content of Mn is less than 0.20%, the strength decreases. If the content of Mn exceeds 0.5%, pearlite increases, and the elongation and the impact value decrease. Therefore, the content of Mn is 0.20 to 0.5%.

If the content of S is less than 0.005%, the graphite nodule count decreases to less than 300/mm$^2$, pearlite increases, and the elongation and the impact value decrease. If the content of S exceeds 0.030%, graphitization is inhibited, the spheroidizing ratio of graphite decreases, and the elongation and the impact value decrease. Therefore, the content of S is 0.05 to 0.030%.

Cu is an element for stabilizing the pearlite structure. If the content of Cu increases, the matrix structure includes a high percentage of pearlite, and the strength increases. If the content of Cu is less than 0.2%, the strength decreases. On the other hand, if the content of Cu exceeds 0.5%, pearlite excessively increases, and the elongation and the impact value decrease. Therefore, the content of Cu is 0.2 to 0.5%.

Mg is an element for affecting graphite spheroidization. A residual amount of Mg is an index for determining the graphite spheroidization. If the residual amount of Mg is less than 0.03%, the graphite spheroidizing ratio decreases, and the strength and the elongation decrease. If the residual amount of Mg exceeds 0.06%, carbide (chilled structure) is easily precipitated, and the elongation and the impact value significantly decrease. Therefore, the content of Mg is 0.03 to 0.06%.

The total contents of Mn and Cu may be 0.45 to 0.60%. If the contents of Mn and Cu are less than 0.45%, the tensile strength is not sufficiently improved. If the contents of Mn and Cu exceed 0.60%, the elongation and the impact value decrease, and desired mechanical properties may not be provided.

By setting a ratio of the content of Si and the total contents of Mn and Cu (Si/(Mn+Cu)) from 4.0 to 5.5, the strength and the elongation may be improved well-balanced, and the amounts of Mn and Cu added may be reduced to minimum. If the ratio is less than 4.0, the elongation and the impact value significantly decrease. If the ratio exceeds 5.5, the tensile strength may decrease.

The tensile strength should be high by including a fixed amount of Mn and Cu in the spheroidal graphite cast iron to increase pearlite in the matrix structure. If large amounts of Mn and Cu are included, the pearlite becomes excess, thereby significantly decreasing the elongation and the impact value. On the other hand, by increasing ferrite in the matrix structure, the elongation and the impact value may be maintained. If Si is dissolved in the ferrite matrix structure, the tensile strength may increase. Note that if excess Si is dissolved, the impact value decreases.

In view of the above, the ratio (Si/(Mn+Cu)) is specified such that the percentage of pearlite and ferrite in the matrix structure is balanced within a specific range, thereby increasing the tensile strength and improving the elongation and the impact value.

An area ratio of pearlite (pearlite ratio) in the matrix structure is calculated using image processing of a metal structure photograph of a cast iron cross-section by (1) extracting a structure excluding graphite, and (2) excluding graphite and ferrite, and extracting a pearlite structure in accordance with (area of pearlite)/(areas of pearlite+ferrite).

Preferably, the pearlite ratio is 30 to 55%.

Examples of the inevitable impurities include P and Cr. If the content of P exceeds 0.05%, steadite is excessively produced, which decreases the impact value and the elongation. If the content of Cr exceeds 0.1%, carbide is easily precipitated, which decreases the impact value and the elongation.

Preferably, the graphite nodule count is 300/mm$^2$ or more, and the average grain size of graphite is 20 μm or less. As described above, when the percentage of pearlite and ferrite in the matrix structure is balanced within a specific range, a graphitization element such as silicon for ferritization is added, thereby increasing the graphite nodule count, and decreasing the grain size of graphite. If the graphite nodule count is 300/mm$^2$ or more, and the average grain size of graphite is 20 μm or less, a large number of minute graphite is distributed, thereby improving an impact value property. On the other hand, if coarse graphite is present in the structure, an internal notch effect is great, a crack length increases to be easily integrated and fractured. The conditions to provide the graphite nodule count being 300/mm$^2$ or more and the average grain size of graphite being 20 μm or less include decreasing the elements (Mn and Cr) added that increase the solubility of C or increasing a cooling speed.

The spheroidal graphite cast iron of the present invention has a tensile strength of 550 MPa or more as-cast state, an elongation of 12% or more, an impact value at normal temperature and −30° C. of 10 J/cm$^2$ or more, and percentage brittle fracture of an impact fracture surface at 0° C. of 50% or less.

Accordingly, the spheroidal graphite cast iron of the present invention is applicable to parts requiring more toughness, e.g., undercarriage such as a steering knuckle, a lower arm, an upper arm and a suspension, and engine parts such as a cylinder head, a crank shaft and a piston.

If the spheroidal graphite cast iron of the present invention is produced, it is preferable to add an inoculant such as a Fe—Si alloy (ferrosilicon) including at least two or more selected from the group consisting of Ca, Ba, Al, S and RE upon casting. A method of inoculating may be selected from ladle inoculation, pouring inoculation, and in-mold inoculation depending on a product shape and a product thickness.

Upon casting, it is preferable to add one or two or more RE selected from the group consisting of La, Ce and Nd as the graphite nodule count increases.

If RE and S are added as the inoculant, a compounding ratio (mass ratio) of (RE/S) is desirably 2.0 to 4.0. S may be added either alone or as a form of Fe—S.

As a method of increasing the graphite nodule count, it is known that lanthanide sulfide is generated as a core of graphite. Only with S in a molten metal, the core is insufficiently generated. As described in Patent Document 1, if an excessive amount of sulfide is added directly before graphite spheroidization, it causes poor spheroidization. In view of this, the inoculant is preferably added after spheroidization.

EXAMPLES

A Fe—Si based molten metal was melted using a high frequency electric furnace. A spheroidizing material (Fe—Si—Mg) was added thereto for sheroidization. Next, Fe—S was added as the inoculant to an Fe—Si alloy (Si: 70 to 75%) including Ba, S, RE such that a compounding ratio of (RE/S) was 2.0 to 4.0. A total of these inoculants were adjusted to about 0.2 mass % to a total of the molten metal to provide each composition shown in Table 1.

The molten metal was poured into a beta set mold 10 having cavities shown in FIG. 1. The mold was cooled to normal temperature, and each molded product was taken out from the mold. The cavities of the beta set mold 10 were simulated for a thickness of a steering knuckle of the vehicle parts, and a plurality of round bars 3 each having a cross-sectional diameter of about 25 mm were disposed. In FIG. 1, a reference numeral 1 denotes a pouring gate, and a reference numeral 2 denotes a feeding head.

Comparative Examples 1 and 2 are the FCD400 material and the FCD550 material in accordance with JIS G 5502, respectively.

The resultant molded products were evaluated as follows:

A graphite nodule count and an average grain size of graphite: An observation site was taken as an image by an optical microscope of 100 magnifications. The image was binarized by an image analysis system. A number and an average grain size of parts darker than a matrix (corresponding to graphite) were measured. The measurement result was an average value of five observation sites. The graphite to be measured had the average grain size of 10 μm or more. The average grain size is an equivalent circle diameter.

The spheroidizing ratio was measured in accordance with JIS G 5502.

FIG. 2 to FIG. 5 show structure photographs of cross-sections of test specimens in Example 1, Example 2, Comparative Example 1, and Comparative Example 2.

Tensile strength and elongation at break: Each round bar 3 of the molded product was cut to produce tensile test specimens by a turning process in accordance with JIS Z 2241. The tensile test specimens were subjected to a tensile test in accordance with JIS Z 2241 using an Amsler universal testing machine (1000 kN) to measure tensile strength and elongation at fracture.

Impact value and percentage brittle fracture: Impact specimens with U-notches were produced from the round bars 3 of the molded product in accordance with JIS Z 2241, and were subjected to an impact test using a Charpy impact tester (50 J) to measure impact values. Fracture surfaces of the specimens after the impact test were taken as images by a microscope. Brittle parts (metallic luster parts) were measured for area percentages using area calculation software to determine a percentage brittle fracture.

FIG. 6 to FIG. 9 show facture surface photographs of the specimens in Example 1, Example 2, Comparative Example 1, and Comparative Example 2 after the impact test (RT: room temperature). White parts with metallic luster in the fracture surfaces are brittle fracture surfaces. As upper white parts of the fracture surfaces are U-notched parts, the U-notched parts are excluded.

TABLE 1

| | Constituent (mass %) | | | | | | | | | | Graphite | | | |
|---|---|---|---|---|---|---|---|---|---|---|---|---|---|---|
| | C | Si | Mn | P | S | Cr | Cu | Mg | (Mn + Cu) | Si/ (Mn + Cu) | Spheroidizing ratio (%) | Graphite nodule count (number/mm2) | Average grain size (μm) | Pearlite ratio (%) |
| Example 1 | 3.64 | 2.14 | 0.26 | 0.022 | 0.008 | 0.028 | 0.24 | 0.045 | 0.5 | 4.28 | 90.6 | 347.9 | 16.6 | 52.6 |
| Example 2 | 3.63 | 2.23 | 0.25 | 0.022 | 0.005 | 0.025 | 0.24 | 0.04 | 0.49 | 4.55 | 92.2 | 351.2 | 16.9 | 41.9 |
| Comparative Example 1 (FCD450) | 3.65 | 2.5 | 0.26 | 0.021 | 0.007 | 0.022 | 0.16 | 0.046 | 0.42 | 5.95 | 91.7 | 208.2 | 23.3 | 26.6 |
| Comparative Example 2 (FCD550) | 3.59 | 2.54 | 0.35 | 0.017 | 0.006 | 0.026 | 0.34 | 0.034 | 0.69 | 3.68 | 91.4 | 236.8 | 20.9 | 52.7 |

TABLE 2

| | Number of experiments | 0.2% Yield Strength (MPa) | Tensile strength (MPa) | Elongation (%) | Impact value (J/cm2) RT | Impact value (J/cm2) −30° C. | Percentage brittle fracture (%) RT | Percentage brittle fracture (%) 0° C. |
|---|---|---|---|---|---|---|---|---|
| Example 1 | n = 1 | 347 | 592 | 14.8 | 16.1 | 11.1 | 1.5 | 34.4 |
| | n = 2 | 340 | 582 | 15.2 | 16.2 | 11.3 | 1.1 | 40.7 |
| | n = 3 | 331 | 570 | 16.1 | 17 | 11.6 | 1.3 | 35.1 |

TABLE 2-continued

| | Number of experiments | 0.2% Yield Strength (MPa) | Tensile strength (MPa) | Elongation (%) | Impact value (J/cm2) RT | Impact value (J/cm2) −30° C. | Percentage brittle fracture (%) RT | Percentage brittle fracture (%) 0° C. |
|---|---|---|---|---|---|---|---|---|
| Example 2 | n = 1 | 338 | 565 | 16.8 | 17.3 | 12.3 | 1 | 8 |
| | n = 2 | 328 | 555 | 17 | 18 | 12.9 | 0.4 | 12.6 |
| | n = 3 | 326 | 553 | 17.1 | 18.4 | 12.3 | 0.3 | 12.2 |
| Comparative Example 1 (FCD450) | n = 1 | 306 | 477 | 20.8 | 19.8 | 12.6 | 2.5 | 58 |
| | n = 2 | 304 | 465 | 21.4 | 19.8 | 12.8 | 2.5 | 60 |
| Comparative Example 2 (FCD550) | n = 1 | 361 | 615 | 10.7 | 10.7 | 6.6 | 62.5 | 100 |
| | n = 2 | 355 | 613 | 10.9 | 11 | 6.8 | 62.5 | 100 |

As apparent from Table 1 and Table 2, in each Example where 0.45 to 0.60% of Mn and Cu are contained in total and a ratio (Si/(Mn+Cu)) is 4.0 to 5.5, the tensile strength is 550 MPa or more and the elongation is 12% or more. Thus, both of the strength and the ductility are improved. Also, in each Example, the graphite nodule count is 300/mm$^2$ or more, the average grain size of graphite is 20 μm or less, the impact value at normal temperature and −30° C. is 10 J/cm$^2$ or more, and the percentage brittle fracture of the impact fracture surface at 0° C. is 50% or less, thereby improving the ductility.

On the other hand, in Comparative Example 1 where less than 0.45% of Mn and Cu are contained in total and the ratio (Si/(Mn+Cu)) exceeds 5.5, the strength decreases.

In Comparative Example 2 where exceeding 0.60% of Mn and Cu are contained in total and the ratio (Si/(Mn+Cu)) is less than 4.0, the ductility decreases.

Figure 10:
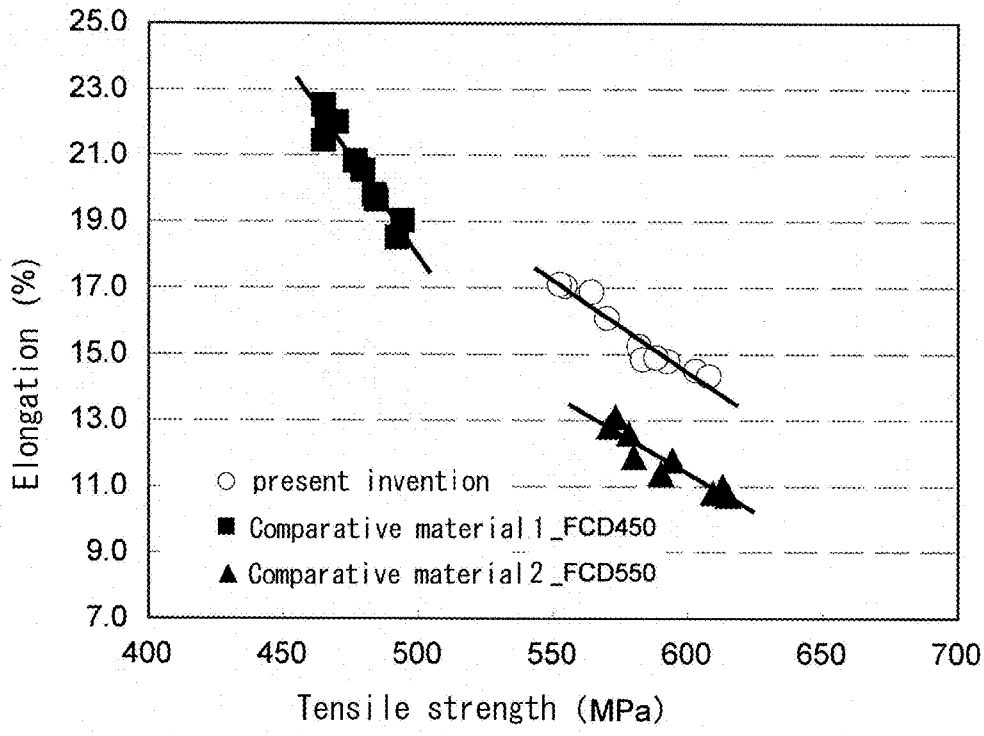
FIG. 10 A drawing showing a relationship between a tensile strength and an elongation in each Example (the present invention) and Comparative Example.

FIG. 10 shows a relationship between the tensile strength and the elongation in each Example (the present invention) and Comparative Example. In Comparative Example 1, although the elongation is as high as 20% or more, a sensitivity of the elongation to the strength is high (the elongation significantly decreases caused by an increase of the strength). Thus, with a slight increase in the strength, the elongation rapidly decreases, resulting in a poor stability of the material. On the other hand, in each Example, the sensitivity of the elongation to the strength is low and stable.

Figure 11:
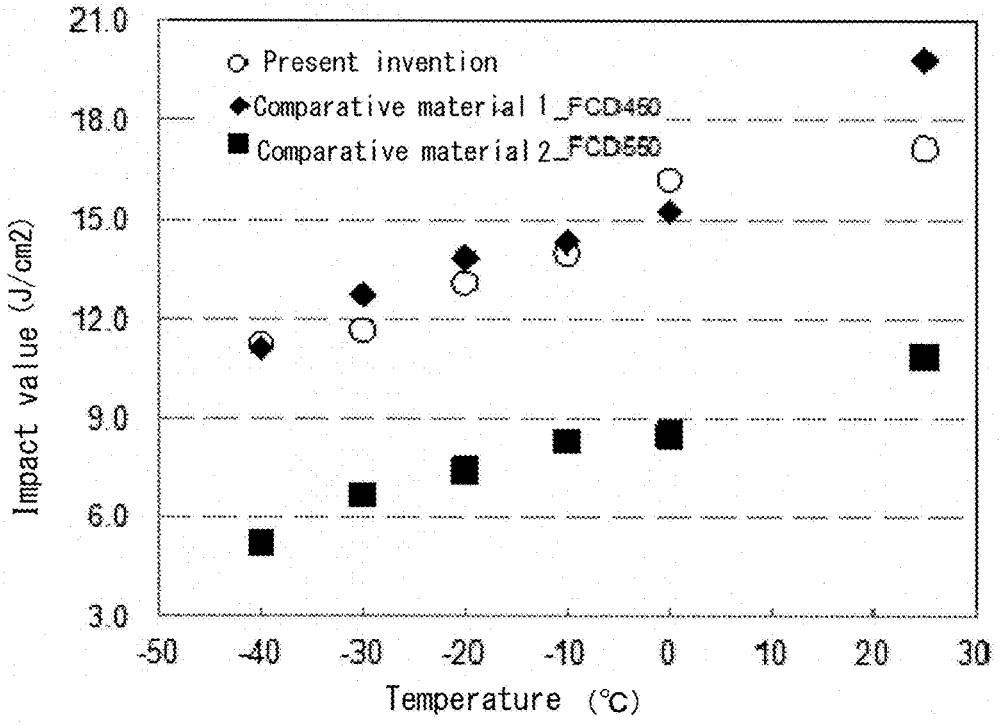
FIG. 11 A drawing showing a relationship between an impact value and a temperature in each Example (the present invention) and Comparative Example.

FIG. 11 shows a relationship between an impact value and a temperature in each Example (the present invention) and Comparative Example. In Comparative Example 2, the impact value at a low temperature (−30° C.) was less than 10 J/cm$^2$.

DESCRIPTION OF REFERENCE NUMERALS

1 pouring gate
2 feeding head
3 round bar
10 beta set mold

What is claimed is:

1. A spheroidal graphite cast iron comprising: C: 3.3 to 4.0 mass %, Si: 2.1 to 2.4 mass %, Mn: 0.20 to 0.50 mass %, S: 0.005 to 0.030 mass %, Cu: 0.20 to 0.50 mass %, Mg: 0.03 to 0.06 mass %, Mn and Cu: 0.45 to 0.60 mass % in total and the balance: Fe and inevitable impurities, wherein a tensile strength is 550 MPa or more, and an elongation is 12% or more, a ratio of the content of Si by mass % and the total contents of Mn and Cu by mass % (Si/(Mn+Cu)) is 4.0 to 5.5, the pearlite area ratio is 30 to 55%, and an impact value at normal temperature and −30° C. is 10 J/cm$^2$ or more, wherein a graphite nodule count is 300/mm$^2$ or more and an average grain size of graphite is less than 20 μm.

2. The spheroidal graphite cast iron according claim 1, wherein a percentage brittle fracture of an impact fracture surface at 0° C. is 50% or less.

* * * * *